United States Patent [19]

Killop et al.

[11] Patent Number: 4,852,375

[45] **Date of Patent: * Aug. 1, 1989**

[54] RACK ASSEMBLY FOR FORMING SPLINES IN THIN-WALL MEMBER

[75] Inventors: James T. Killop, Warren; Carl E. Anderson, Mt. Clemens, both of Mich.

[73] Assignee: Anderson-Cook, Inc., Fraser, Mich.

[ * ] Notice: The portion of the term of this patent subsequent to Mar. 8, 2005 has been disclaimed.

[21] Appl. No.: 100,543

[22] Filed: Sep. 24, 1987

Related U.S. Application Data

[62] Division of Ser. No. 862,458, May 12, 1986, Pat. No. 4,729,233.

[51] Int. Cl.[4] ..... B21H 5/00; B21H 17/04

[52] U.S. Cl. ..... 72/88

[58] Field of Search ..... 72/88, 90, 469, 102–105, 72/108

[56] References Cited

U.S. PATENT DOCUMENTS

| | | | |
|---|---|---|---|
| 236,085 | 12/1880 | Reynolds . | |
| 1,266,402 | 5/1918 | Canda . | |
| 2,262,698 | 11/1941 | Pelland | 72/90 |
| 2,317,244 | 4/1943 | Bailey | 72/90 |
| 3,214,951 | 11/1965 | McCardell . | |
| 3,982,415 | 9/1976 | Killop | 72/88 |
| 4,045,988 | 9/1977 | Anderson | 72/108 |
| 4,206,535 | 6/1980 | Roth | 72/88 |

FOREIGN PATENT DOCUMENTS

| | | |
|---|---|---|
| 227938 | 11/1985 | Japan . |
| 538792 | 12/1976 | U.S.S.R. . |

*Primary Examiner*—Daniel C. Crane

*Attorney, Agent, or Firm*—Reising, Ethington, Barnard, Perry & Milton

[57] ABSTRACT

An apparatus (10) and die assembly (26, 30) for forming a splined power transmission member from a thin-walled blank. The apparatus (10) comprises a pair of die assemblies (26, 30), each including a supporting frame (28), first (42) and second (44) die bodies independently mounted on the supporting frame (28) in end-to-end coaxial relationship with each other, with rough (46) and finish (48) spline-forming surfaces formed on the first (42) and second (44) die bodies, respectively. The pair of die assemblies (26, 30) are supported with the spline-forming surfaces of the respective die bodies (42, 44) in spaced, oppoosed, parallel relationship to each other. A power drive mechanism sequentially moves the pair of die assemblies (26, 30) in opposed directions. The power drive means effectuates a rough spline-forming stroke and then returns the die assemblies (26, 30) to the neutral position.

1 Claim, 3 Drawing Sheets

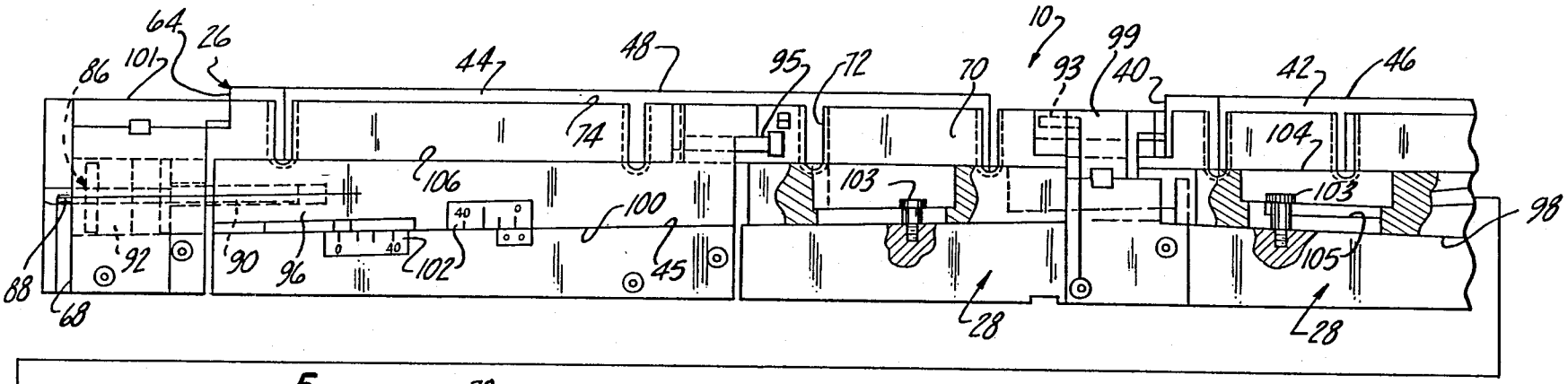
Fig-4
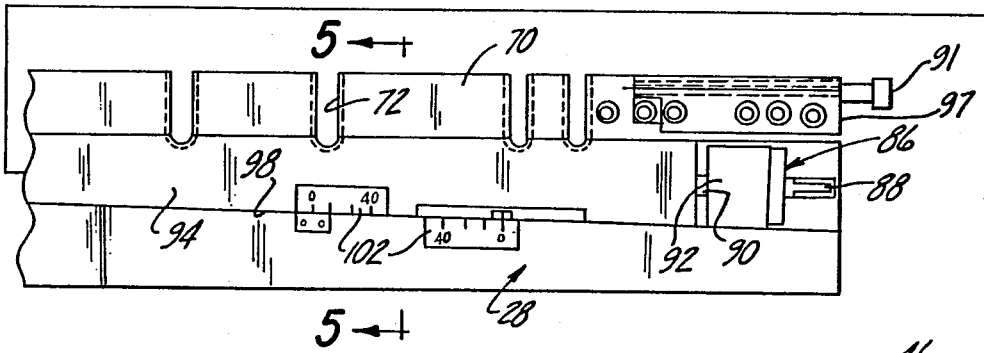
Fig-5
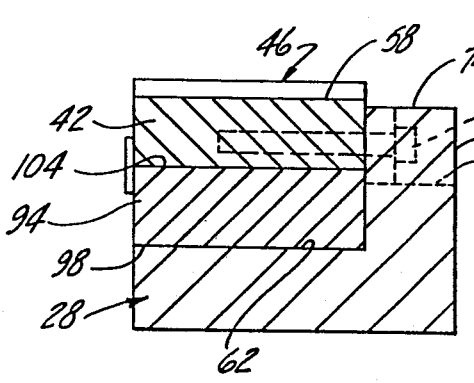

RACK ASSEMBLY FOR FORMING SPLINES IN THIN-WALL MEMBER

This is a division, of application Ser. No. 862,458, filed on May 12, 1986 now U.S. Pat. No. 4,729,233.

TECHNICAL FIELD

This application relates to an apparatus and die assembly for making a power transmission member from a thin-walled blank.

BACKGROUND OF THE INVENTION

The coupling and uncoupling of clutch components within a vehicle's automatic transmission clutch is accomplished by the use of clutch discs and a power transmission member embodied as a clutch hub.

U.S. Pat. No. 3,982,415, issued Sept. 28, 1976 to the same assignee as this invention discloses a machine for splining a power transmission member by rolling. An externally toothed pinion-type mandrel of the machine is rotatably mounted between a pair of elongated die racks. An unsplined member is supported by the mandrel so that sliding movement of the elongated dies from initial end-to-end relationship to an overlapping relationship meshes the teeth on the dies and the teeth on the mandrel with a thinwalled annular sleeve portion of the member therebetween. The meshing of the die and mandrel teeth deforms the sleeve portion of the member radially in a rolling member, forming splines as the mandrel rotates. The die racks each have rough and finish-forming toothed surfaces extending from one end to the other along the face of each die and are driven in opposed direction on either side of the mandrel by a drive train. Opposed synchronizing teeth extend along each die, respectively, for simultaneously forming splines in opposite sides of the blank.

A problem that has arisen from this configuration is the tendency for the finish-forming surfaces to exhibit disproportionately more wear than the rough-forming surfaces, due to the increased stress on the finishing teeth on the die during the latter stages of the spline-forming operation. Consequently, a one-piece die having both the rough and finish-forming surfaces thereon must be entirely reground, or in some instances discarded, although only the finishing surface is worn or cracked due to the strain. Even the unworn finish forming surface must be reground to allow for alignment of the finish forming teeth with the reground rough-forming teeth on the same one piece die. This leads to unnecessary waste and the higher cost associated with replacing an entire one-piece die member.

STATEMENT OF INVENTION AND ADVANTAGES

According to the invention, there is provided an apparatus and die assembly for forming splines in a thin-walled blank. The apparatus comprises a pair of die means for forming the splines, each of the die means including first and second die bodies independently mounted on the apparatus in end-to-end coaxial relationship with each other, the first die bodies including rough spline-forming surfaces and the second die bodies including finish-forming surfaces. The pair of die assemblies are supported with the spline-forming surfaces of the respective die bodies in spaced, opposed, parallel relationship to each other. A power drive means sequentially moves the pair of die assemblies in opposed directions from a neutral position in which the rough spline-forming surface of the first die body of one of the pair of die means is in opposed relationship to the finish spline-forming surface of the second die body of the other of the pair of die assemblies to effectuate a rough spline-forming stroke in which the rough spline-forming surface of the first die body of the one die means is in opposed parallel relationship to the rough spline-forming surface of the first die body of the other die means and then back through the neutral position to a finish spline-forming stroke in which the die means are moved to a position in which the finish spline-forming surface of the second die body of one of the die means is in opposed parallel relationship to the finish spline-forming surface of the second die body of the other die means and then returned to the neutral position.

An advantage of the instant invention is that each die rack has an independent supporting structure allowing the forming portions thereof to be independently removed and efficiently replaced when that portion becomes cracked or worn, without also replacing the unworn portion of the die rack.

Another advantage of the instant invention is the cost savings of replacing only one section of the die member that consistently undergoes a disproportionate amount of wear during the splining operation, eliminating the necessity of removing the entire die member for regrinding and machining of all the teeth on the rough and finish-forming surfaces.

FIGURES IN THE DRAWINGS

The objects, advantages and features of the invention will become apparent from the following detailed description when considered in connection with the accompanying drawings wherein:

FIG. 4 is a side-elevational view, partially cut away, of one of the racks of the apparatus of FIG. 1;

FIG. 5 is a sectional view taken on lines 5—5 of FIG. 4; and

DETAILED DESCRIPTION OF PREFERRED EMBODIMENTS

Figure 1:
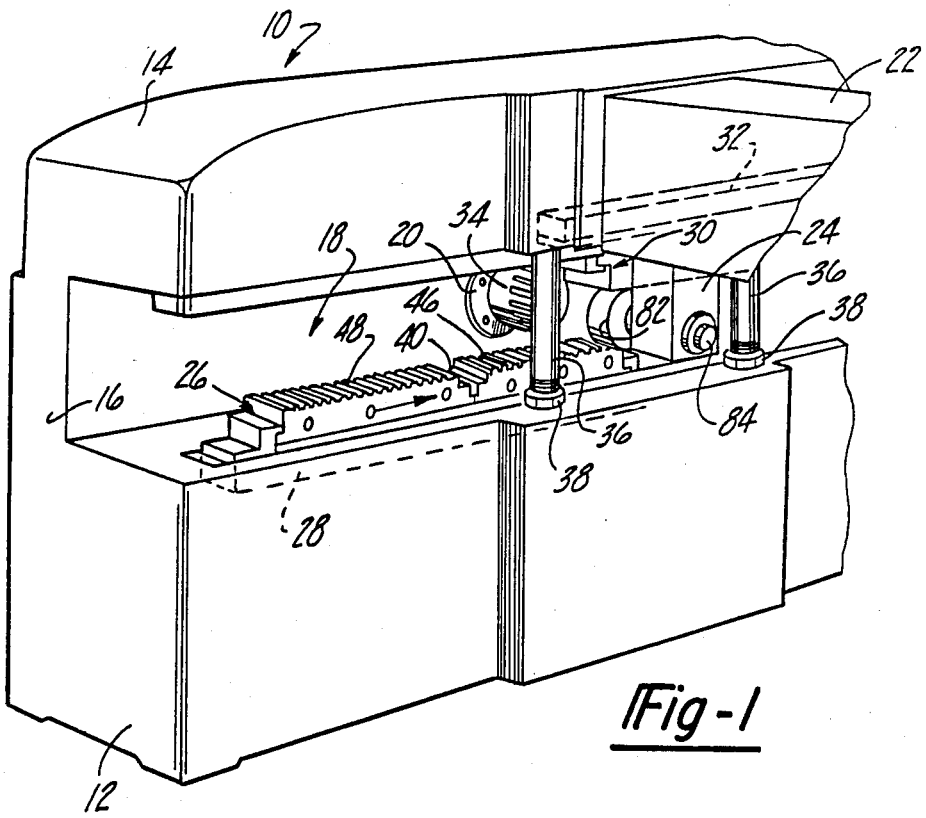
FIG. 1 is a perspective view of apparatus embodying the invention.

In FIG. 1, an apparatus for forming splines in a thin-walled blank, such as a power transmission member, is generally indicated by reference numeral 10, including a lower support base 12, an upper base 14, and an intermediate support portion 16. The support portion 16 extends upwardly from the lower base 12 and the upper base 14 extends forwardly from the support portion 16 to cooperate with the lower base in defining a work space, generally indicated at 18. Within the work space 18, a fixed head stock 20 is mounted on the support portion 16 between the lower and upper bases 12 and 14. A tail stock support arm 22 projects from the upper base 14 and includes a suitable slide arrangement for supporting a tail stock 24. The tail stock 24 depends downwardly from the support arm 22 and is slidably movable toward and away from the head stock 20 along a rectilinear path.

One of a pair of die means comprises a lower elongated die generally shown at assembly 26 slidably mounted on the lower base 12 within the work space 18 by a lower frame structure indicated in phantom lines at 28. The other of the die means comprises an elongated upper die assembly generally shown at 30 similarly mounted on the upper base 14 of the apparatus 10 by an upper frame indicated in phantom lines at 32. The die assemblies 26, 30 are respectively mounted in a parallel spaced relationship relative to each other for opposed movement on opposite sides of a toothed mandrel 34 having a blank 35 received thereon to perform a splining operation on the blank 35. The die assemblies 26, 30 are sequentially movable by suitable power means, that coordinate the movement of each die assembly with that of the other to perform a splining operation described below. A pair of rods 36 extend between the lower and upper bases 12 and 14 and are threaded into the lower bases to control the deflection permitted between the die assemblies 26, 30 as the splining operation proceeds. Rotation of the rods 36 increases or decreases tension along the rod lengths.

Figure 2:
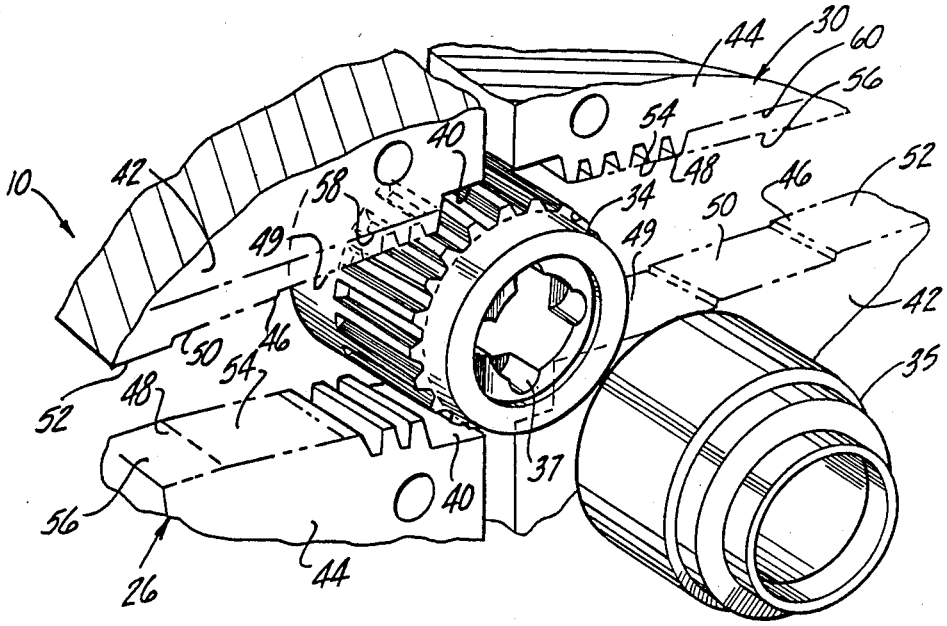
FIG. 2 is an enlarged perspective view of a portion of the apparatus of FIG. 1 just prior to commencement of the splining operation.
Figure 3:
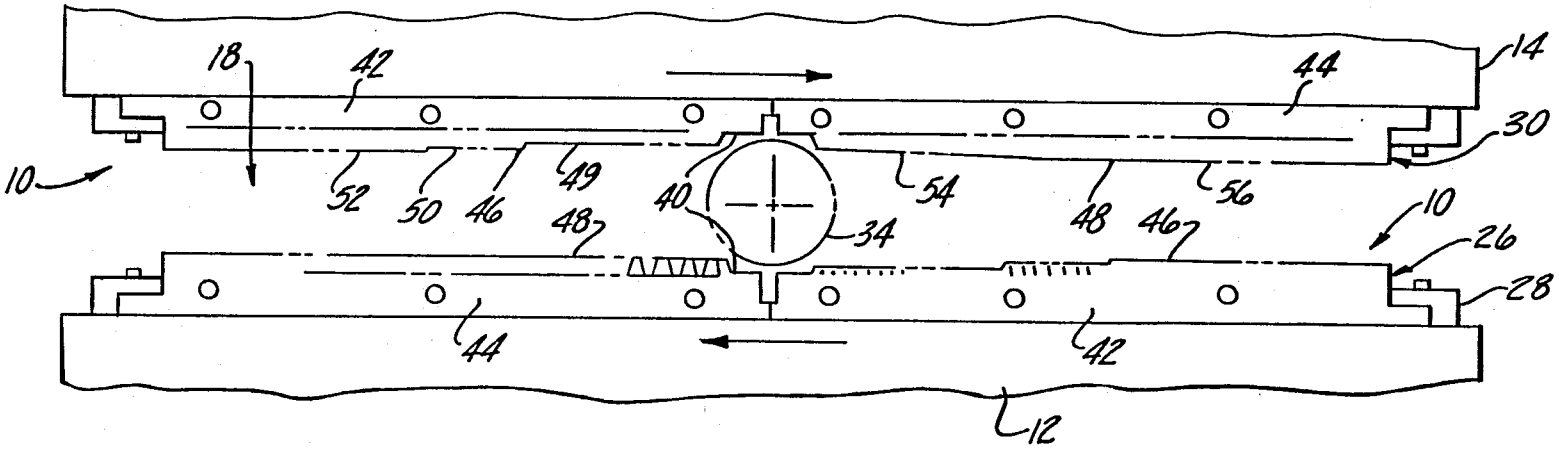
FIG. 3 is a side-elevational view of a portion of the apparatus of FIG. 1 with the dies in the neutral position.
Figure 6:
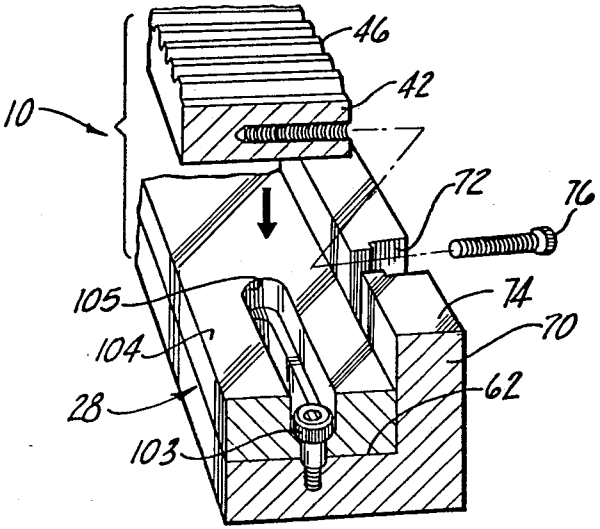
FIG. 6 is an exploded, enlarged, perspective view of a cut-away portion of FIG. 4.

As shown in FIGS. 3 and 4, each one of the die assemblies 26, 30 includes first 42 and second 44 die bodies independently mounted on an associated wedge shaped upper surface 45 of the frame 28 in end-to-end coaxial relationship with each other and separated by a loading notch 40 for receiving the mandrel 34 when the die assemblies 26, 30 are in an entirely overlapping or neutral position with the notches 40 aligned on opposite sides of the mandrel 34 prior to a spline-forming operation. A rough-forming surface 46 is supported on the first die body 42 and a finish-forming surface 48 is supported on the second die body 44. The rough-forming surface 46 has a plurality of longitudinally extending groups of rough-forming teeth 49, 50, 52 and the finish-forming surface has leading 54 and trailing 56 groups of longitudinally extending finish-forming teeth 54, 56. As shown in FIG. 2, the teeth 49, 50, 52 on the rough-forming surface 46 extend from a common planar base 58 and having progressively increasing heights from group to group and the teeth 54, 56 on the finish-forming surface 48 likewise extend from a common planar base 60. The pair of die assemblies 26, 30 are supported with the spline-forming surfaces 46, 48 of the respective die bodies 42, 44 in spaced, opposed, parallel relationship to each other in the neutral position. In other words, when in the neutral position, each spline-forming surface 46, 48 is aligned with and separated from an opposite of its kind of surface, as well as being in spaced and opposed relationship to another opposite of its kind of surface.

The power drive means sequentially moves the pair of die assemblies 26, 30 in opposite directions from a neutral position in which the rough spline-forming surface 46 of the first die body 42 of one of the pair of die assemblies 26 is in opposed relationship to the finish spline-forming surface 48 of the second die body 44 of the other of the pair of die assemblies 30 to a rough spline-forming stroke in which the rough spline-forming surface 46 of the first die body 42 of the one die assembly 26 is in opposed parallel relationship to the rough spline-forming surface 46 of the first die body 42 of the other assembly 30 and then back through the neutral position to a finish spline-forming stroke in which the die assemblies 26, 30 are moved in the opposite direction to a position in which the finish spline-forming surface 48 of the second die body 44 of one of the die assemblies 26 is in opposed parallel relationship to the finish spline-forming surface 48 of the second die body 44 of the other die assembly 30 and then returned to the neutral position. The movement is one complete cycle.

Referring to FIG. 4, each of the die assemblies 26, 30 has adjustment means, generally indicated at 86, for independently adjusting the first 42 and second 44 die bodies of one of the die assemblies 26 on the associated supporting frames 28 of the apparatus 10 in a direction transverse to the longitudinal axes of the die bodies 42, 44 and toward and away from the other die assembly 30.

The lower die assembly 26 is shown in FIG. 4 mounted on the wedge shaped surface 45 of the support frame 28. The support frame 28 is preferably one piece. The top wedge shaped surface 45 that is sloped downwardly from the midpoint of the support frame 28 adjacent the notch 40 to either end thereof. The support frame 28 is generally L-shaped in cross section, having an upright portion 70 extending longitudinally along an internal edge of the support frame 28. The upright portion 70 has open slots 72 extending inwardly from the top edge 74 thereof. The slots 72 respectively receive a plurality of mounting bolts 76 therethrough for independently securing each of the die bodies 42, 44 to the upright portion 70 of the frame. The slots 72 allow vertical adjustment of the position of connection of the bolts 76. That is, the bolts 76 may be secured at any position along the length of the slots 72 to allow for adjustments described below. In this manner, each die body 42, 44 is independently mounted on the support frame 28, allowing removal and replacement of the die body 44 having the finish-forming surface 48 thereon. As aforementioned, the finish-forming surface 48 exhibits proportionately more wear than the rough-forming surface 46, due to increased stress during the finish-forming stage of the spline-forming operation; hence, replacement of the finish-forming surface 48 will more often be necessitated. Of course, the rough-forming surface 46 may be similarly replaced.

The loading and unloading operation is accomplished by an arbor 82 mounted on the tail stock 24 and including a shaft 84 projecting toward the head stock 20. The tail stock 24 is movable toward and away from the mandrel 34, allowing the mandrel to accept a clutch hub blank 35 supported on an end thereof. The tail stock 24 is then moved toward the head stock 20 so that the end of the mandrel opening 37 receives the shaft 84. The fixed head stock 20 and movable tail stock 24 then mount and support the mandrel 34 in a rotatable fashion about a fixed axis which is located midway between the upper and lower dies 26 and 30. For this purpose, an automatic feed rack may hold a number of blanks 35 which may be successively fed onto the mandrel 34 by the tail stock 24.

An important operational feature of the invention is that the teeth on the rough 46 and finish 48 forming surfaces must be precisely synchronized to form splines in the blank 35 as the mandrel 34 rotates. Therefore, the lateral position and height of opposing pairs of teeth with respect to one another and the mandrel 34 is crucial and must be maintained when a die body 42, 44 is replaced. Where one of the pair of die bodies 42, 44 becomes worm and is removed and replaced, it is necessary to recalibrate the height of the teeth on the replaced die body to assure the precise height of the teeth relative to opposing teeth on the other of the die bodies to synchronously form splines in the blank member 35.

For this purpose, there is provided adjustment means, generally indicated at 86, in the form of a screw-type adjuster 88 operating a set screw 90 projecting from a locking member 92 affixed to the upper surface 62 of the frame 28. Bolts 91 and 93 and 95 operate in conjunction with the adjuster 88 to laterally position a pair of wedge blocks 94, 96 between heel blocks 47, 97 and 101. The adjustment means 86 longitudinally moves a pair of wedge blocks 94, 96 respectively situated in sliding engagement on the upper surface 62 of the frame 28 on either side of the loading notch 40 and secured by bolts 103 within slots 105 in the upper surface 45 of the support frame 28. Each of the wedge blocks 94, 96 have lower surfaces 98, 100 sloped outwardly and downwardly from the inner end of each wedge block 94, 96 to the outer opposite end adjacent the adjustment means 86. The angle of incline of the lower surfaces 98, 100 of the wedge blocks is complementary to the angle of the upper surfaces 45 of the frame 28 to independently raise and lower each die body 42, 44 perpendicularly by loosening first the bolts 76 that travel in the slots 72, respectively, and removing the die bodies 42, 44. The bolts 103 are then loosened and the wedge blocks 94, 96 are moved longitudinally. Slots 105 allow for the movement along their length. To allow more accurate calibration of height adjustments, a pair of vernier indicators 102 are provided on the support frame 28 and each die body 26, 30 or wedge block 94, 96, respectively. When the desired vernier adjustment has been made in the height of the die teeth, the bolts 103 are then tightened to maintain the adjusted position of the wedge blocks 94, 96. The die bodies 42, 44 are then secured by bolts 76 on the top surfaces 104, 106 of the wedge blocks 94, 96.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A die assembly (26) for forming a splined power transmission member from a thin-walled blank (35) comprising: a supporting frame (28); first (42) and second (44) die bodies independently mounted on said frame (28) in end-to-end coaxial relationship with each other; said first die body (42) including a rough spline forming surface (46) and said second die body (44) including a finish spline-forming surface (48); a loading notch (40) formed along said rough (46) and finish (48) forming surfaces for receiving a mandrel (34) with the blank (35) mounted thereon in a neutral position of said die assembly (26); a pair of inclined wedge blocks (94, 96) each slideably supported for longitudinal movement along a complementary abutment surface (62) on said frame (28) and having one of said die bodies (42, 44) supported thereon to perpendicularly raise and lower each die body (42, 44), including an actuator (88) for longitudinally moving each of said wedge blocks (94, 96) and a locking screw (103) to maintain the position thereof for providing for independent replacement and recalibrating of said independently mounted die bodies (42, 44) having rough and finish forming surfaces (46, 48).

* * * * *